United States Patent [19]

Chase

[11] 3,962,734

[45] June 15, 1976

[54] THERMOFORMED WADING POOL WITH INTEGRAL SLIDE AND HANDRAIL

[75] Inventor: Ascher Chase, Virginia Beach, Va.

[73] Assignee: General Foam Plastics Corporation, Norfolk, Va.

[22] Filed: Sept. 3, 1974

[21] Appl. No.: 502,364

Related U.S. Application Data

[63] Continuation-in-part of Ser. No. 396,680, Sept. 13, 1973, Pat. No. 3,908,205.

[52] U.S. Cl. ..... 4/172; 272/56.5 R; D34/5 F

[51] Int. Cl.[2] ..... E04H 3/16; E04H 3/18

[58] Field of Search ..... 4/172, 172.19, 173, 4/177, 185 R, 185 H; D13/1 G; 272/56.5 R; D34/5 F

[56] References Cited

UNITED STATES PATENTS

| | | | |
|---|---|---|---|
| 3,497,877 | 3/1970 | Diemond et al. | 4/172 |
| 3,665,523 | 5/1972 | Chase | 4/172 |
| 3,668,715 | 6/1972 | Chase | 4/172 |
| 3,708,807 | 1/1973 | Chase | 4/172 |
| 3,793,653 | 2/1974 | Brooks | 4/172 |

*Primary Examiner*—Richard E. Aegerter
*Assistant Examiner*—Stuart S. Levy
*Attorney, Agent, or Firm*—Mandeville and Schweitzer

[57] ABSTRACT

A wading pool, sandbox or like thermoformed structure is provided with an integral slide, hollow handrail, and steps molded into the structure. The structure is configured to provide the slide and a slide mounting platform, disposed above the top of the side walls of the structure, with sufficient strength and rigidity in combination to require only a single, simplified, inverted U-shaped, tubular support under the slide mounting platform adjacent and within the hollow peripheral edge of the structure, to stabilize and to support the slide mounting platform. With such an arrangement, assembly is simplified and the container may be easily folded after assembly for transport without dismantling.

5 Claims, 3 Drawing Figures

THERMOFORMED WADING POOL WITH INTEGRAL SLIDE AND HANDRAIL

BACKGROUND OF THE INVENTION AND RELATION TO COPENDING APPLICATION

This application is a continuation-in-part of Application Ser. No. 396,680, filed Sept. 13, 1973, now U.S. Pat. No. 3,908,205.

As is well known, many vacuum formed or otherwise molded thermoplastic wading pools, sandboxes, and the like have been proposed as play areas for small children. Moreover, such structures have been proposed incorporating integral central or side slides and/or seats which enhance the attractiveness and play value of the structures. Separate ladder steps and handrails are typically provided for the central slide pools. In addition, integral mounting platforms for the slides have been proposed which are well above the top edge of the peripheral walls of the container providing a longer and higher slide and greater play value than slides which extend from or below the peripheral flanges of the container.

SUMMARY OF THE PRESENT INVENTION

In accordance with the present invention, a wading pool or sandbox is provided with an integral side slide and with an integral elevated mounting platform therefor disposed well above the top edges of the peripheral wall of the container, which slide has integral handrails and integral steps to the mounting platform. The new structure is comprised of a single sheet of a thermoplastic material which may be vacuum formed into the final configuration of the structure. The structure is so configured with integrally formed supporting ribs, steps, and handrails in a manner whereby only a single, symmetrical U-shaped tubular support member is required and assembly is simplified. This support is disposed adjacent the peripheral edge of the pool in a manner in which no portion of the tubular support extends inwardly of the container. Thus, the pool may be readily folded for transport, as desired, after assembly of the support.

The new pool structure, in accordance herewith, are vacuum formed from thermoplastic sheet material under heat and pressure by known techniques. The thermoplastic sheet material may be, for example, polyethylene, polypropylene, or copolymers thereof with other olefin monomers, polystyrene or the like.

Accordingly, with the foregoing and other objects in view, this invention will now be more particularly described, and other objects and advantages hereof will be apparent from the following description taken in conjunction with the accompanying drawings.

DETAILED DESCRIPTION OF A PREFERRED EMBODIMENT OF THE INVENTION

Figure 1:
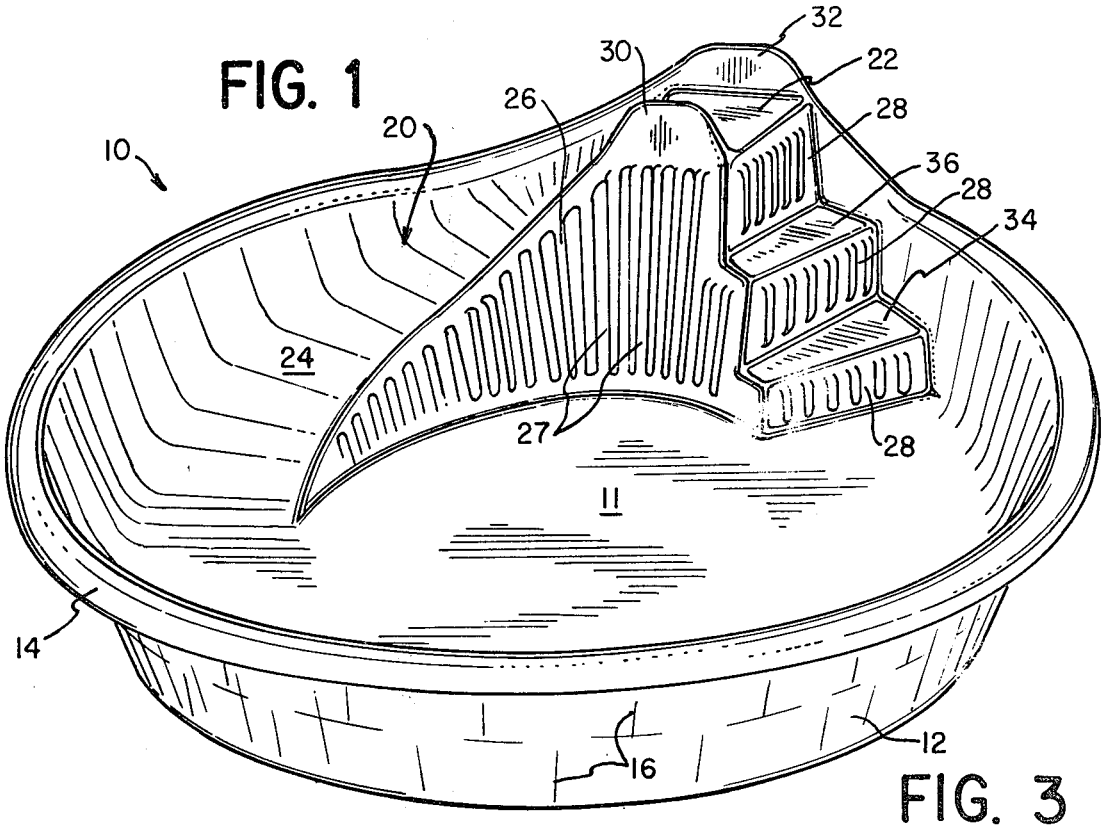
FIG. 1 is a perspective view of a wading pool embodying the invention.

Referring now to the drawings, like reference numerals refer to like elements throughout the several views thereof. As indicated in FIG. 1, the new wading pool 10 is comprised of a bottom wall 11 surrounded by a circular upstanding wall 12. (Although the wading pool is shown as circular in form, it will be understood that it is within the purview of this invention that the pool may be rectangular, oblong, square, etc.) A flange 14, having an arcuate cross section, is provided along the upper edges of the wall 12. As is conventional with such pools, the side walls 12 may have been incorporated therein molded-in ribs 16 or the like for providing enhanced rigidity and/or design to the walls.

As illustrated in FIG. 1, an integral side slide, generally designated 20, is formed as part of the container, and it includes a slide mounting platform 22 elevated substantially above the peripheral flange 14 circumscribing the pool. An inclined partially helical slide surface 24 extends from platform 22 to the bottom wall 11 of the container. The slide and platform have wide ribs 27 formed in tapered side wall 26. The ribs 27 of side wall 26 provide enhanced rigidity for the slide and platform.

Integral web-like steps 34 and 36, extend in horizontal planes between the slide wall 26 and the outer pool wall 12. Step wall 28 of step 34 extends from the bottom wall 11 to the front edge of the step, and step wall 28 of step 36 extends from the back edge of step 34 to the front edge of step 36, as shown. Front walls 28 of steps 34, 36 and platform 22 also have wide ribs 27 to enhance the rigidity of the steps and slide platform.

Figure 2:
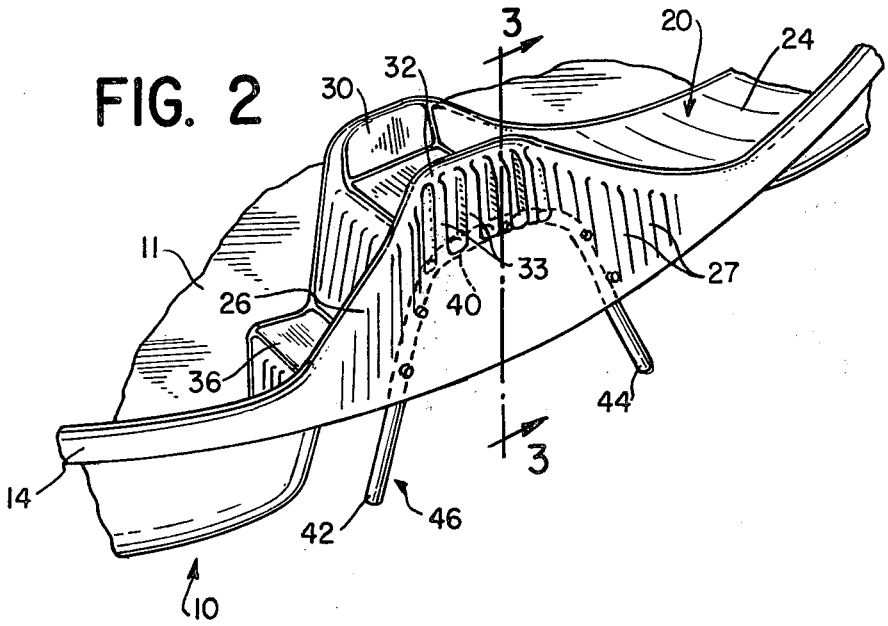
FIG. 2 is a perspective view of the wading pool of FIG. 1, showing the details of the slide platform and its support.

In accordance with the invention as shown in FIGS. 1 and 2, integral handrails 30, 32 project upwardly from side wall 26, and side wall skirt portion 31, which is formed as an integral extension of flange 14 adjacent slide platform 22, to provide hand grips for the user in the vicinity of platform 22.

Figure 3:
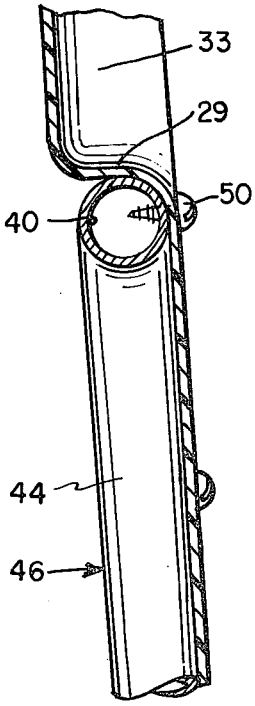
FIG. 3 is a section taken along lines 3—3 of FIG. 2.

As an important aspect of the invention and as shown in FIGS. 2 and 3, a single, inverted U-shaped support 46, which may be formed, for example, from aluminum tubing or injection molded plastic, is sufficient to reinforce and to support the integral side slide and its mounting platform. The supporting structure 46 is comprised of vertical legs 42, 44 interconnected by an upper horizontal crossbar portion 40 extending beneath the platform 22. The legs 42, 44 are generally converging, which enhances further the rigidity of the entire structure. More specifically as shown in FIG. 3, the crossbar 40 is disposed under integral horizontal wall 29 which forms the base for integral wide ribs 33 formed in skirt 31. None of the supporting structure extends into the container body itself to interfere with folding of the container. The crossbar 40 has a single, centrally disposed hole for receiving a bolt and nut 48 for attaching the supporting structure 46 to the container structure. Similarly, each of the legs 42, 44 has one or more holes for receiving bolts and nuts 50 for securing the lowermost portions of the skirt 31 to the support. It will be apparent, however, that the connecting bolts may be arranged differently and more may be used if desired, or other fasteners, e.g. self-tapping screws, may be used.

Thus, as should be apparent from the foregoing, there is provided in accordance herewith an improved thermoformed play structure or container for use as a wading pool, sandbox, or the like, having an integral side slide with molded-in handrails. Most importantly, the new structure reduces external support for the slide structure to a single, simple support which may be simply and quickly assembled with the pool. Only a few fasteners are required to attach the support.

The new structure enables a substantial reduction in the costs of thermoformed side slide pools to be realized. It should be emphasized, further, that with only a single, simple support, without separate steps or the like, an entire integrated structure is provided with a built-in slide, built-in handrails and built-in steps. Since the entire new pool structure is formed from a single sheet of thermoplastic material and a single support brace, the new structure is particularly adapted for mass production techniques. Thus, the new and improved pool structure compares most favorably from cost, use and functional aspects with known thermoformed side slide pools.

While the arrangements of the new structure herein described constitute preferred embodiments of this invention, it is to be understood that the invention is not limited to these precise arrangements of structure, and that changes may be made therein without departing from the scope of the invention which is defined in the appended claims.

I claim:

1. In a container structure comprised of a single thermoformed sheet of plastic material having a flat bottom wall of predetermined configuration and circumscribing peripheral side walls of a predetermined height extending upwardly therefrom; a flange at the upper edge of said side walls; and an integral sliding surface sloping upwardly from said bottom wall along said peripheral side walls to a mounting platform therefor; the improvement comprising a. a side wall for said slide structure and said mounting platform extending from said flat bottom wall to said mounting platform, said side wall being rigidified by heavy vertical ribs;

b. a hollow handrail on each side of said mounting platform, one of said handrails including portions integral with said slide wall and forming an upwardly extending extension thereof; and c. the other of said handrails including portions integral with said flange adjacent said platform and forming an upwardly extending extension thereof, said upwardly extending flange portion including an enlarged skirt portion adjacent said platform;

d. said inner surfaces of said skirt portion accommodating the insertion therein and attachment thereto of a support leg means.

2. The container structure of claim 1, further including a. rigid support leg means fastened to said skirt portion.

3. The container structure of claim 2, in which a. said support leg means is a single, generally U-shaped aluminum tube including a generally horizontal crossbar extending between a pair of converging legs.

4. The container structure of claim 3, in which a. the upper extension of said skirt portion has heavy vertical ribs disposed therein, said ribs extending to a substantially horizontal integral wall formed in said skirt portion; the upper surface of said crossbar is disposed against said horizontal integral wall of said skirt portion; and b. each of said legs and said crossbar of said support is fastened to said skirt portion by mechanical fastening means.

5. The container structure of claim 1, in which a. a plurality of integral steps are disposed adjacent said platform on the side thereof opposite said sliding surface, said steps extending from said slide surface to said peripheral walls of said container.

* * * * *